US009818279B2

(12) United States Patent
Bernhardt

(10) Patent No.: US 9,818,279 B2
(45) Date of Patent: Nov. 14, 2017

(54) BLAST SENSOR AND MOBILE COMMUNICATION DEVICE

(71) Applicant: The Boeing Company, Chicago, IL (US)

(72) Inventor: Roger D. Bernhardt, O'Fallon, MO (US)

(73) Assignee: The Boeing Company, Chicago, IL (US)

( * ) Notice: Subject to any disclaimer, the term of this patent is extended or adjusted under 35 U.S.C. 154(b) by 162 days.

(21) Appl. No.: 14/339,046

(22) Filed: Jul. 23, 2014

(65) Prior Publication Data

US 2016/0027275 A1 Jan. 28, 2016

(51) Int. Cl.
*G08B 21/00* (2006.01)
*G08B 21/02* (2006.01)
*G08B 21/10* (2006.01)

(52) U.S. Cl.
CPC ..... *G08B 21/02* (2013.01); *G08B 21/10* (2013.01)

(58) Field of Classification Search
CPC ..... G08B 21/02; G08B 21/10
USPC ..... 340/665
See application file for complete search history.

(56) References Cited

U.S. PATENT DOCUMENTS 5,703,835 A * 12/1997 Sharkey ..... G01S 3/801 367/124
8,036,065 B2 * 10/2011 Baxter ..... G01S 5/22 367/128
8,494,585 B2 7/2013 Chapman
8,955,421 B1 * 2/2015 Kountotsis ..... F41C 27/00 89/1.11
2004/0100868 A1 * 5/2004 Patterson, Jr. ..... F41H 11/00 367/127
2004/0199409 A1 * 10/2004 Brown ..... A61B 5/150854 705/3
2007/0241919 A1 * 10/2007 Valentini ..... F41J 5/056 340/665
2008/0008044 A1 * 1/2008 Patterson ..... G01S 5/22 367/128
2010/0148975 A1 * 6/2010 Riley ..... G08B 21/0297 340/665
2010/0275676 A1 * 11/2010 King ..... G01L 5/14 73/35.14
2010/0312188 A1 * 12/2010 Robertson ..... A61B 5/0006 604/156

(Continued)

OTHER PUBLICATIONS

Operations_Military—Compressed; The Blast Gauge System—Captures Vital Data for Operations,Training, and Research; www.blastgauge.com, 2013 BlackBox Biometrics, Inc. (2 pgs).

(Continued)

*Primary Examiner* — Zhen Y Wu
(74) *Attorney, Agent, or Firm* — Toler Law Group, PC

(57) ABSTRACT

A device includes an interface adapter configured to physically couple to a corresponding interface adapter of a mobile communication device. The device includes a blast sensor configured to generate blast data based on one or more measurements and to communicate the blast data to the mobile communication device via the interface adapter. The device further includes a housing at least partially enclosing the blast sensor and at least partially enclosing the mobile communication device.

17 Claims, 5 Drawing Sheets

(56) References Cited

U.S. PATENT DOCUMENTS

| | | | | |
|---|---|---|---|---|
| 2012/0063270 | A1* | 3/2012 | Angell | G01S 5/0027 367/127 |
| 2013/0282937 | A1 | 10/2013 | Chapman | |
| 2014/0120891 | A1* | 5/2014 | Chen | H04W 4/001 455/418 |
| 2014/0265642 | A1* | 9/2014 | Utley | H02J 1/06 307/151 |
| 2014/0361886 | A1* | 12/2014 | Cowdry | G08B 13/1672 340/522 |
| 2014/0364102 | A1* | 12/2014 | Pham | H04W 52/283 455/418 |
| 2014/0364162 | A1* | 12/2014 | Juang | H04W 52/146 455/522 |
| 2015/0054639 | A1* | 2/2015 | Rosen | G06K 9/00785 340/439 |
| 2015/0069219 | A1* | 3/2015 | Klein | G01T 1/026 250/208.1 |
| 2015/0177363 | A1* | 6/2015 | Hermann | G01S 5/20 367/118 |
| 2015/0194045 | A1* | 7/2015 | Edwards | G08B 13/1672 340/540 |

OTHER PUBLICATIONS

Operations_Tactical—Compressed; The Blast Gauge System—Captures Vital Data for Operations,Training, and Research; www.blastgauge.com, 2013 BlackBox Biometrics, Inc. (2 pgs).

Research_Training—Compressed; The Blast Gauge System—Captures Vital Data for Operations,Training, and Research; www.blastgauge.com, 2013 BlackBox Biometrics, Inc. (2 pgs).

* cited by examiner

BLAST SENSOR AND MOBILE COMMUNICATION DEVICE

FIELD OF THE DISCLOSURE

The present disclosure relates to a blast sensor that is coupled to or integrated within a mobile communication device.

BACKGROUND

Improvised explosive devices (IEDs) have been a source of injury to military personnel. After an explosion of an IED, conditions of soldiers and other personnel can be difficult to assess due to risk of the presence of other IEDs or remoteness of the blast from rescue personnel. In some circumstances, soldiers and other personnel may be equipped with sensors to detect explosions. However, such sensors are generally freestanding and can add bulkiness and undesired weight to the soldiers and personnel carrying the sensors. Additionally, although the sensors may record data they may not address other problems associated with responding to explosions, such as providing access to soldiers or other personnel after the blast.

SUMMARY

In a particular embodiment, a blast sensor is integrated with or coupled to a mobile communication device (such as a smartphone). The blast sensor may be adapted to detect high pressure events such as pressure waves accompanying an explosion or blast. As used herein, a blast refers to an explosion or a high pressure wave often accompanied by high temperature, such as during an explosion of an improvised explosive device (IED). The blast sensor may be adapted to gather blast data and to provide the blast data via a notification message to a remote device using communications capabilities of the mobile communication device. The blast data may include information such as a severity of the blast, an assessment of conditions of a user of the mobile communication device, a direction of the blast relative to the user, other information about the blast, such as an overpressure level, or a temperature.

Additionally, the notification message may include data determined based on other sensors of the mobile communication device. For example, the notification message may include audio or video captured prior to, during, or after the blast. Additionally, the notification message or another communication may include information about movement of the user such as accelerometer readings, global positioning system (GPS) locations, compass headings, other movement info, or a combination thereof, during or after the blast. In another example, the notification message or another communication may include an estimate of a carrying location of the mobile communication device on the user, such as in a hip pocket, in a breast pocket, coupled to a belt, or other locations relative to the user. In another example, the notification message or another communication may include results of an assessment of the user after the blast. For example, the mobile communication device may conduct an initial assessment of the user based on the blast data, based on tests conducted by the mobile communication device, such as a speech response test, based on images captured by the mobile communication device, or a combination thereof. Accordingly, the blast sensor interfaced with or coupled to the mobile communication device may facilitate providing information to response personnel that are remote from a location of a blast to enable the response personnel to respond to potentially injured personnel after the blast.

In a particular embodiment, a device includes an interface adapter configured to physically couple to a corresponding interface adapter of a mobile communication device. The device includes a blast sensor configured to generate blast data based on one or more measurements and to communicate the blast data to the mobile communication device via the interface adapter. The device further includes a housing at least partially enclosing the blast sensor and at least partially enclosing the mobile communication device.

In another particular embodiment, a mobile communication device includes a blast sensor configured to generate blast data based on one or more measurements. The mobile communication device further includes a communication subsystem configured to send and receive voice and data communications and to transmit a notification message based on the blast data.

In another particular embodiment, a method includes receiving, via a wired interface of a mobile communication device, blast data based on one or more measurements from a blast sensor. The method further includes transmitting, from the mobile communication device, a notification message based on the blast data.

The features, functions, and advantages that have been described can be achieved independently in various embodiments or may be combined in yet other embodiments, further details of which are disclosed with reference to the following description and drawings.

DETAILED DESCRIPTION

Particular embodiments of the present disclosure are described below with reference to the drawings. In the description, common features are designated by common reference numbers throughout the drawings.

Figure 1:
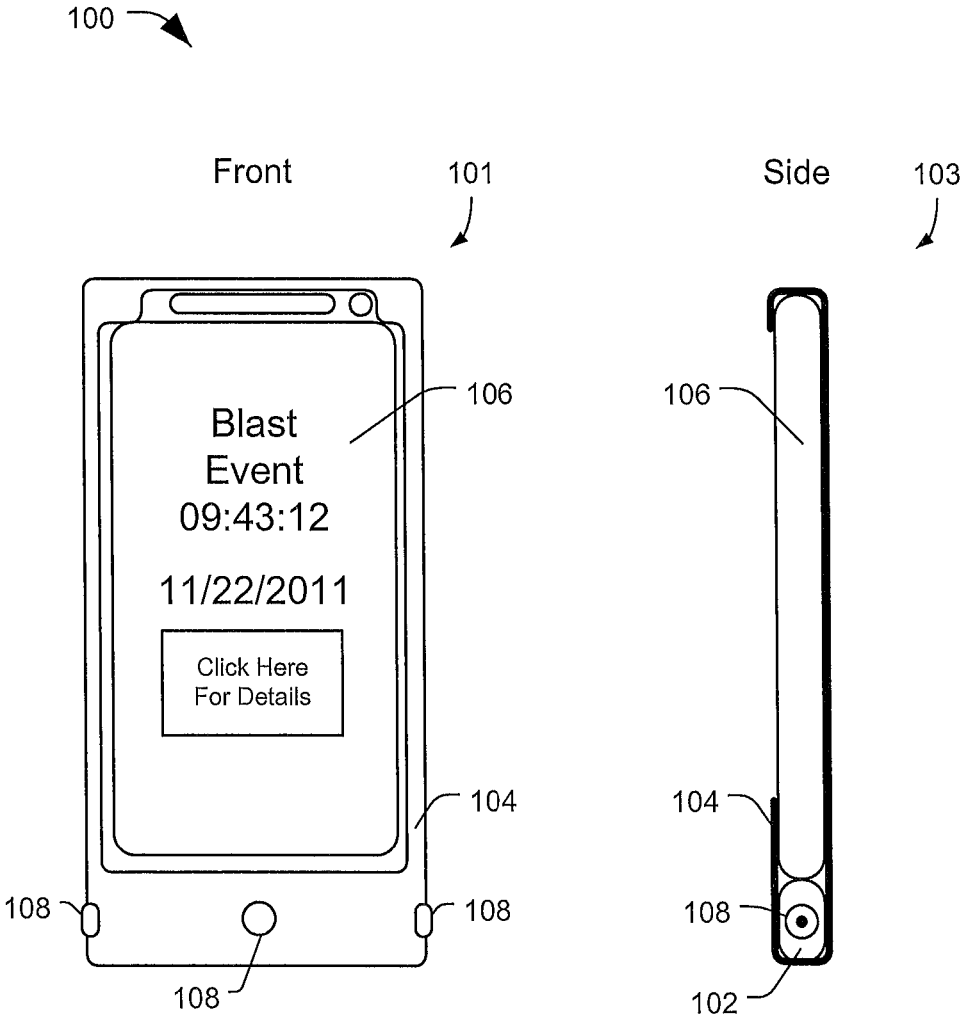
FIG. 1 is a diagram that illustrates a first embodiment of a system including a blast module coupled to a mobile communications device.

FIG. 1 depicts a first embodiment of a system 100 including a blast module 102 coupled to a mobile communications device 106. In FIG. 1, a front view 101 and a side view 103 of the mobile communication device 106 and the blast module 102 are shown. In a particular embodiment, the blast module 102 may be coupled to or may be a component of a smartphone case that includes a housing 104 in which the blast module 102 is retained. In this embodiment, the housing may at least partially enclose the mobile communication device 106. The blast module 102 may interface with the mobile communication device 106 via an interface adapter of the blast module 102 and a corresponding interface adapter of the mobile communication device 106. The interface adapter of the blast module 102 and the corresponding interface adapter of the mobile communication device 106 may be "physically coupled," such as via wired interfaces or multi-pin interfaces, as compared to wireless interfaces. For example, the interface adapters of the blast module 102 and the mobile communication device 106 may conform to an interface standard, such as a universal serial bus (USB) standard. In another example, the interface adapters of the blast module 102 and the mobile communication device 106 may be proprietary connectors, such as proprietary 30-pin smartphone connectors (e.g., "30-pin dock connectors").

The blast module 102 may include one or more blast sensor ports 108 to enable a blast sensor within the blast module 102 to detect a severity of a pressure wave corresponding to a blast. In some embodiments, the one or more blast sensor ports 108 may also enable the blast sensor to detect a direction of the pressure wave corresponding to the blast. Based on blast data detected by the blast sensor, the mobile communication device 106 may display information associated with a blast event. For example, the mobile communication device 106 may display a time stamp associated with the blast event, a date associated with the blast event, and a button to enable a user to view additional details associated with the blast event. The blast data may be sent by the mobile communication device 106 to other devices, as described with reference to FIG. 2. In a particular embodiment, the housing 104 may include other components such as a power supply configured to provide supplemental power to the mobile communication device 106 to increase longevity of battery life of the mobile communication device 106. Additionally, in at least one embodiment, the housing 104 may provide shock protection for the mobile communication device 106 to protect the mobile communication device 106 during use or during the blast.

Figure 2:
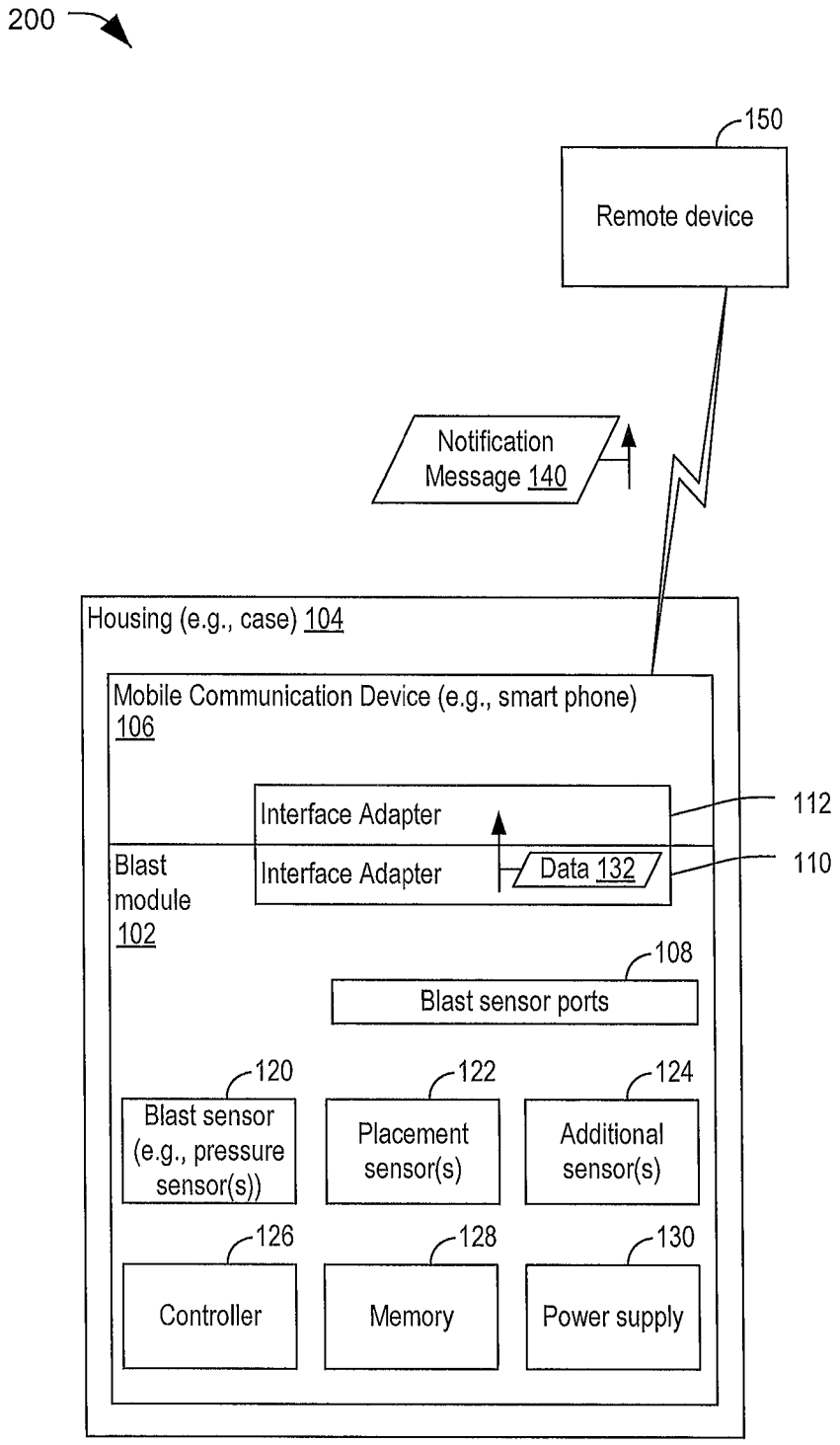
FIG. 2 is a block diagram that illustrates a second embodiment of a system that includes the blast module and the mobile communication device of FIG. 1.

FIG. 2 depicts a block diagram of a second embodiment of a system 200 that includes the blast module 102 and the mobile communication device 106 of FIG. 1. In FIG. 2, the mobile communication device 106 is retained within the housing 104 and is coupled to the blast module 102 via an interface adapter 110 of the blast module 102 and a corresponding interface adapter 112 of the mobile communication device 106. The interface adapter 110 of the blast module 102 and the corresponding interface adapter 112 of the mobile communication device 106 may be "physically coupled," as described with reference to FIG. 1. The blast module 102 includes a blast sensor 120. For example, the blast sensor 120 may be coupled to the one or more blast sensor ports 108 of the blast module 102. The blast sensor 120 may include, for example, a pressure sensor or multiple pressure sensors that are adapted to take measurements of a propagating pressure wave in order to determine (e.g., distinguish) a direction of propagation of the pressure wave, an intensity of the pressure wave, or other information regarding the pressure wave. Such information may be used to characterize a blast experienced by a user and may be indicated by blast data generated by the blast sensor 120. For example, the blast data may include information indicative of the direction of propagation of the pressure wave, information indicative of an intensity (e.g., severity) of the pressure wave, or other information regarding the pressure wave.

The blast module 102 may also include one or more additional sensors 124. For example, the additional sensors 124 may include a temperature sensor, a movement sensor such as an accelerometer or a gyroscope, a global positioning system (GPS) sensor, a compass, or other sensors that facilitate gathering additional information about the blast, about a condition of the user, about a position of the user, or other data that is useful to facilitate response to the blast by response personnel. The additional sensors 124 may communicate additional data to the mobile communication device 106 via the interface adapter 110 of the blast module 102 and the corresponding interface adapter 112 of the mobile communication device 106.

The blast module 102 may also include a placement sensor 122. The placement sensor 122 may be configured to generate carrying location data that is an estimate of a carrying location of the mobile communication device 106 on a body of the user prior to, during, or after the blast. For example, the carrying location data may indicate that the mobile communication device 106 is carried in a pocket, or external to a pocket. To illustrate, the placement sensor 122 may include a light sensor that determines an ambient light level prior to, during, or after the blast. By determining the ambient light level, the placement sensor 122 may determine that the mobile communication device 106 is within a pocket or is being held in a hand of the user, for example. The carrying location data may be communicated to the mobile communication device 106 via the interface adapter 110 of the blast module 102 and the corresponding interface adapter 112 of the mobile communication device 106. The carrying location data may be used to determine a condition of the user. For example, if a change to the carrying location data exceeds a threshold condition associated with the carrying location, an injury to the user may be determined. As another example, when the carrying location data indicates that the mobile communication device 106 is being carried in a pocket prior to a blast event and indicates that the mobile communication device 106 is no longer being carried in the pocket after the blast event, an action (e.g., capturing image data or video data) may be initiated to determine a location of the user after the blast event.

The blast module 102 may also include a controller 126 such as a processor or application specific integrated circuit that facilitates analysis or initiation of actions based on output of the blast sensor 120. The controller 126 may be coupled to or may include a memory 128. The memory 128 may store data generated by the blast sensor 120, the placement sensors 122, the additional sensors 124, or the controller 126. Additionally, the memory 128 may store results of analysis of the data from the blast sensor 120, the placement sensors 122, or the additional sensors 124. The controller 126 may also be configured to provide data 132, via the interface adapter 110 of the blast module 102, to the mobile communication device 106. For example, the data 132 may include blast data from the blast sensor 120, carrying location data from the placement sensor 122, additional data from the additional sensors 124, or a combination thereof. Additionally or alternatively, the data 132 may include results of analysis of data from the blast sensor 120, the placement sensor 122, the additional sensors 124, or a combination thereof. The blast module 102 may also include a power supply 130 that is adapted to provide power to the blast sensor 120, to provide power to the mobile communication device 106 via the interface adapter 110 of the blast module 102 and the interface adapter 112 of the mobile communication device 106, or both.

During operation, the blast sensor 120 may generate blast data based on one or more measurements, such as one or more pressure measurements detected by the blast sensor 120. The blast data may be communicated to the mobile communication device 106 via the interface adapter 110 of the blast module 102 and the corresponding interface adapter 112 of the mobile communication device 106. Additionally or alternatively, the controller 126 may analyze the blast data and provide an analysis or results of an analysis as the data 132 provided to the mobile communication device 106. The mobile communication device 106 may be adapted to generate a notification message 140 that is transmitted to a remote device 150. For example, the notification message 140 may be transmitted via a wireless wide area network (WAN), such as a cellular telephone network or another radio network, to enable response personnel at the remote device 150 to respond to the blast. The notification message 140 may include the blast data output by the blast sensor 120, the carrying location data output by the placement sensors 122, additional data output by the additional sensors 124, analysis generated by the controller 126, or other data indicating a time, a date, and a location at which the blast occurred. The notification message 140 may also include information identifying the mobile communication device 106 or a user of the mobile communication device 106.

Additionally, during operation, in response to detecting blast data that satisfies a threshold condition, the controller 126 may initiate a responsive action. The threshold condition may include a threshold overpressure condition, a threshold temperature, an overpressure condition that is associated with other conditions such as a threshold movement or a threshold displacement of the mobile communication device 106, an audible report associated with the blast, a high temperature flash, or other conditions. In response to detecting that the blast data satisfies the threshold condition, the controller 126 may initiate a responsive action, such as causing audio data to be stored at the memory 128 or at a memory of the mobile communication device 106, causing the audio data to be transmitted to the remote device 150, causing video data to be stored at the memory 128 or at a memory of the mobile communication device 106, causing the video data to be transmitted to the remote device 150, causing location data to be stored at the memory 128 or a memory of the mobile communication device 106, causing the location data to be transmitted to the remote device 150, or a combination thereof.

As another example, the controller 126 may be adapted to initiate an action such as analyzing (e.g., processing) the blast data and the additional data from additional sensors 124 to estimate a severity of the blast. For example, the controller 126 may estimate a severity of the blast by comparing pressure data, a temperature, a movement or displacement, or other measurements from the blast sensor 120 or the additional sensors 124 to corresponding thresholds or to severity level data stored in the memory 128. The severity level data may correlate one or more measurements to severity levels of blast events and may be based on simulated data or based on data associated with prior blast events. The controller 126 may initiate the estimation in response to the blast data satisfying a threshold condition, such as a pressure threshold.

As another example, the controller 126 may be adapted to respond to the blast data satisfying a threshold condition by causing the mobile communication device 106 to open a communication channel to a remote device 150. For example, the communication channel may be an open voice call, data call, or voice and data call. To illustrate, in response to the controller 126 determining that the blast data satisfies a threshold condition, the blast module 102 may cause the mobile communication device 106 to generate a voice call to the remote device 150. The voice call may enable the user associated with the mobile communication device 106 to provide voice response input to the remote device 150 or to a user of the remote device 150. For example, emergency response personnel associated with the remote device 150 may be able to vocally interact with the user of the mobile communication device 106 to assess the condition of the user.

Thus, the blast module 102 in cooperation with the mobile communication device 106 enables a user, such as a soldier carrying the mobile communication device 106, to be provided with automated blast response and sensing without burdening the soldier with additional equipment, since the soldier or other user may be utilizing the mobile communication device 106 for other purposes, such as communication with command centers or other soldiers. Additionally, because the mobile communication device 106 and the blast module 102 are at least partially encased in the housing 104, supplemental power and protection may be provided to the mobile communication device 106 via the power supply 130 and the housing 104, respectively, without burdening the soldier with additional equipment.

Figure 3:
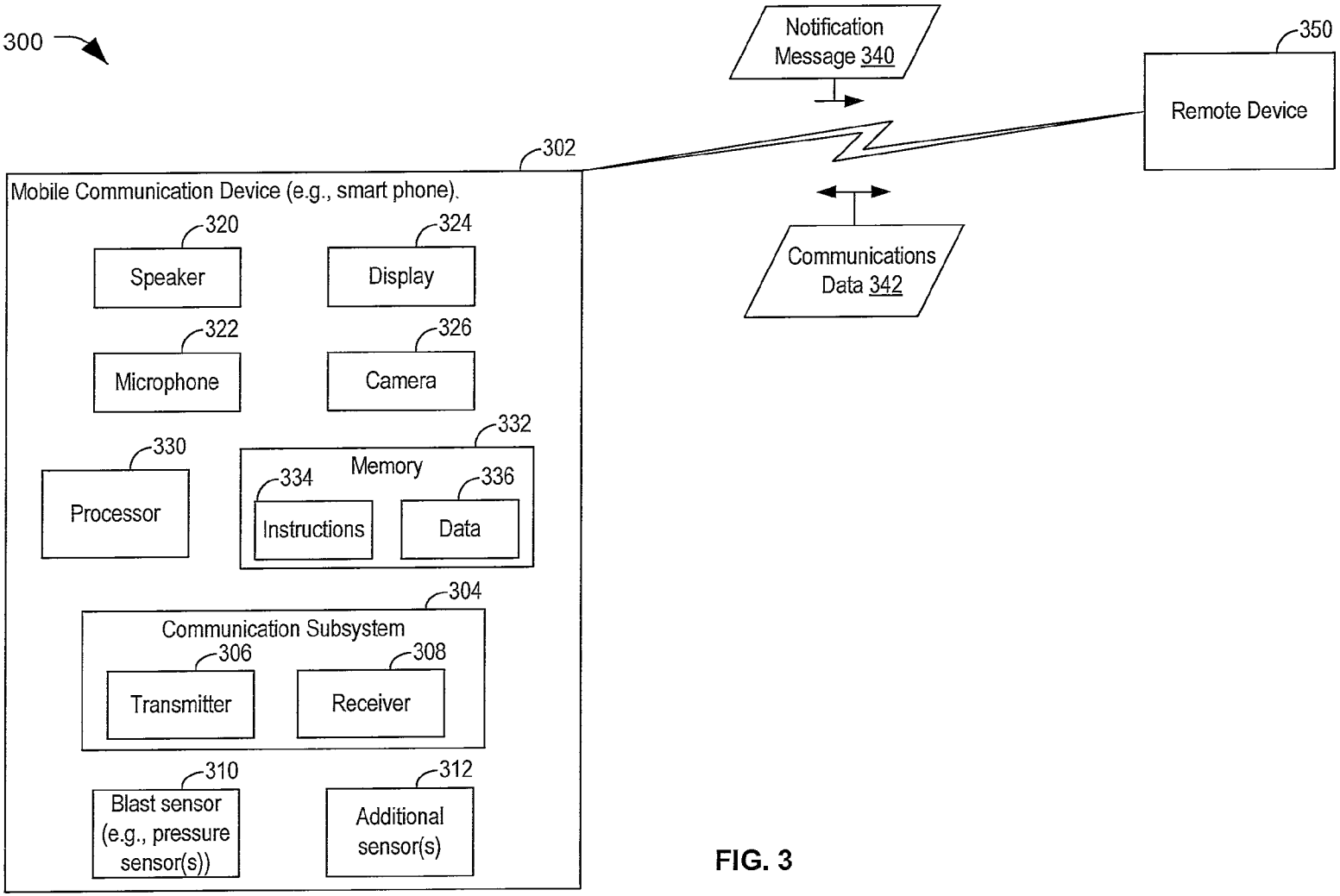
FIG. 3 is a diagram that illustrates an embodiment of a system that includes a blast sensor.

FIG. 3 illustrates a third embodiment of a system 300 including a blast sensor 310. In the example illustrated in FIG. 3, a mobile communication device 302 has an integrated blast sensor 310. The integrated blast sensor 310 may be adapted to generate blast data based on one or more measurements of a blast. The mobile communication device 302 may include a smartphone or other mobile communication device that includes a communication subsystem 304. For example, the communication subsystem 304 may include a transmitter 306 and a receiver 308. In other embodiments, the transmitter 306 and the receiver 308 may be integrated into a transceiver of the communication subsystem 304. The communication subsystem 304 may be configured to send and receive communications data 342. For example, the mobile communication device 302 may include a microphone 322 to receive vocal or audio input from a user, which may be encoded and communicated via the communication subsystem 304 as the communications data 342 to the remote device 350. Similarly, the communications data 342 from the remote device 350 may be received by the communication subsystem 304 and decoded to generate audible output at a speaker 320 of the mobile communication device 302. The mobile communication device 302 may also include, for example, a display 324 that enables interaction with the user via a graphical user interface. As another example, the mobile communication device 302 may include a camera 326 configured to capture still images and corresponding image data and/or video images and corresponding video data. The still images and/or video images may be communicated via the communications data 342 to the remote device 350. As another example, text communications, such as text messages or electronic mail (e-mail) messages, may be encoded and communicated via the communication subsystem 304 as the communications data 342.

The mobile communication device 302 may also include a processor 330 and memory 332 accessible to the processor 330. The memory 332 may store instructions 334 that are executable by the processor 330. The memory 332 may also store data 336 (e.g., sensor data) which is accessible to the processor 330 and which may be communicated via the communications data 342 to the remote device 350.

In a particular embodiment, the blast sensor 310 includes one or more pressure sensors that are adapted to take measurements of ambient pressure to detect a pressure wave propagating proximate to the user of the mobile communication device 302. For example, the pressure sensors may periodically sample the ambient pressure, and in response to the ambient pressure exceeding a pressure threshold, the pressure sensors may take the measurements of the ambient pressure during a blast event. Blast data may be generated based on the measurements and, responsive to the blast data satisfying a threshold condition, the processor 330 may implement a responsive action such as generating and transmitting the notification message 340 to the remote device 350. For example, the processor 330 may compare a characteristic (e.g., pressure, temperature, etc.) indicated by the blast data to a threshold condition associated with the characteristic and, in response to determining that the characteristic exceeds the associated threshold condition, the processor 330 may generate and transmit the notification message 340. The notification message 340 may be based on the blast data. For example, the notification message 340 may include or indicate the blast data or a subset of the blast data, analysis based on the blast data (and additional data), an indication that the blast data satisfies a threshold condition, or a combination thereof. Alternatively, the notification message 340 may include data from the additional sensors 312 or from other components of the mobile communication device 302, such as from the microphone 322 or the camera 326, or the data 336 stored in the memory 332.

During operation, in a particular example, responsive to the processor 330 determining that the blast data satisfies a threshold condition, the processor 330 may activate the microphone 322, the camera 326, or both to generate media data. For example, the media data may be stored at the memory 332 as the data 336. The media data or a portion of the media data may also be included in the notification message 340 or in the communications data 342 to the remote device 350. In another example, the microphone 322, the camera 326, or both may continuously store and update media data at the memory 332, such that recorded media data for a particular time period prior to the blast is stored at the memory 332. In this example, responsive to the blast data satisfying the threshold condition, the media data may be transmitted via the notification message 340 or via the communications data 342 to the remote device 350. In this example, the media data acts as a record of what was occurring audibly or visually relative to the user a few moments (e.g., the particular time period) prior to or during the blast.

In another example, responsive to the blast data satisfying the threshold condition, the processor 330 may activate one or more additional sensors 312 to generate additional data. The additional data may also be stored as the data 336. In this example, the additional data may be analyzed with the blast data to estimate a severity of the blast, a condition of the user before, during, or after the blast, or other information. In another example, the additional sensors 312 may be continuously active and may store and update data at the memory 332. In this example, the data 336 may correspond to readings from the additional sensors 312 for a particular duration of time prior to the blast. Responsive to the blast data satisfying the threshold condition, the processor 330 may transmit the additional data from the additional sensors 312 via the notification message 340 or via the communications data 342 to the remote device 350. In this example, the additional data provides a record of readings from the additional sensors 312 a few moments (e.g., the particular time period) prior to or during the blast.

The processor 330 may be adapted to execute the instructions 334 to estimate an intensity of the blast based on the blast data from the blast sensor 310, the additional data from the additional sensors 312, or both. For example, the processor 330 may estimate a severity of the blast by comparing pressure data, a temperature, a movement or displacement, or other measurements from the blast sensor 310 or the additional sensors 312 to corresponding thresholds or to severity level data stored in the memory 332. The severity level data may correlate one or more measurements to severity levels of blast events and may be based on simulated data or based on data associated with prior blast events. In this example, information about the estimated intensity of the blast may be provided via the notification message 340 to the remote device 350.

As another example, the processor 330 may execute the instructions 334 to estimate potential injuries to the user based on the blast data from the blast sensor 310, the additional data from the additional sensors 312, or both. For example, based on an overpressure condition sensed by the blast sensor 310, a temperature flash, a displacement of the user, an acceleration experienced by the user, or other measurements from the additional sensors 312, the processor 330 may estimate a severity of injuries experienced by the user. In this example, the processor 330 may estimate a severity of the injuries by comparing the overpressure condition, the temperature flash, the displacement of the user, the acceleration experienced by the user, or the other measurements to corresponding thresholds or to injury level data stored in the memory 332. The injury level data may correlate one or more measurements to injury levels of the user and may be based on simulated data or based on data associated with injuries experienced during prior blast events.

In another example, the processor 330 may execute the instructions 334 to generate post-blast data. The post-blast data may be indicative of a location of the user after the blast, movement of the user after the blast, or both. The location and movement of the user may correspond to the location and movement of the mobile communication device 302. For example, the post-blast data may indicate whether the user is moving, a distance that the user has moved in a particular time period after the blast, or both. In another example, when the mobile communication device 302 and the user are separated during the blast, the post-blast data may include image data or video data that may indicate the position of the user relative to the mobile communication device 302 (e.g., if the camera 326 is facing the user). The post-blast data may be provided to the remote device 350 via the notification message 340 or via the communications data 342. In a particular embodiment, the processor 330 may initiate generation of a post-blast message indicating the post-blast data when the blast data satisfies a threshold condition. In another example, after determining that the blast data satisfies a threshold condition, the processor 330 may cause the communication subsystem 304 to initiate a voice communication session or a data communication connection with the remote device 350. In this example, the processor 330 may cause the communication subsystem 304 to generate a call to the remote device 350 to enable an operator or response personnel associated with the remote device 350 to interact vocally with the user of the mobile communication device 302 or to enable the operator or the response personnel to gather real-time audio data, video data, or both from the mobile communication device 302.

Thus, the mobile communication device 302 provides blast sensing and user evaluation such as injury evaluation after a blast using the same device (e.g., a mobile communication device) that enables a user to conduct voice and data communications, such as voice calls, data calls, or voice and data calls with remote devices. By performing the blast sensing and the user evaluation, the mobile communication device 302 provides response personnel with information that may be helpful to facilitate recovery or rescue of the user of the mobile communication device 302. Additionally, because the mobile communication device 302 provides other useful functions (e.g., voice and data communications), the mobile communication device 302 is likely to be carried by the user in many circumstances. By enabling the mobile communication device 302 to provide the blast sensing and the user evaluation, such functions are provided to a user without adding a burden of additional equipment.

Figure 4:
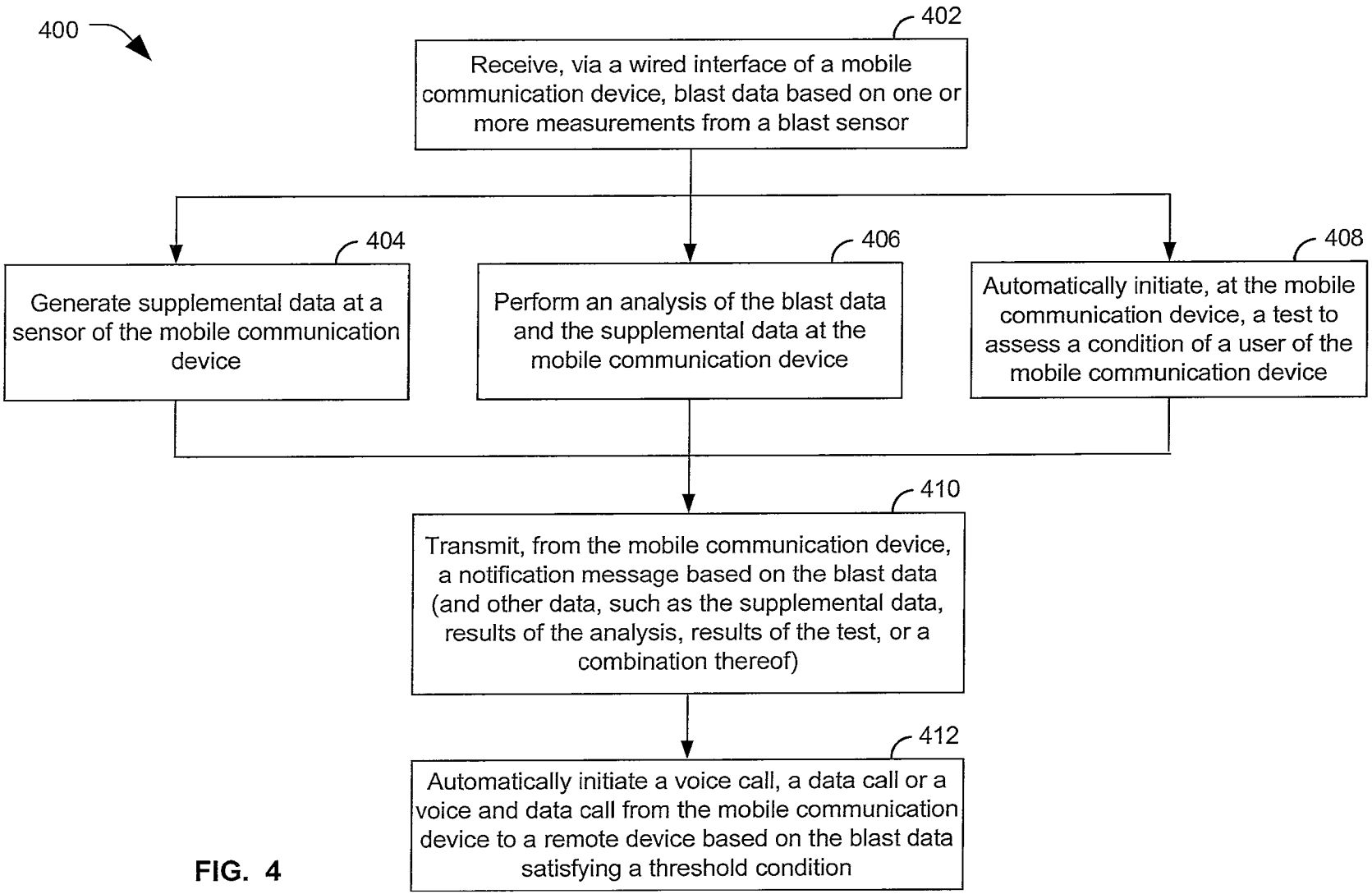
FIG. 4 is a flow chart of a particular embodiment of a method of transmitting a notification message based on blast data.

FIG. 4 depicts a flowchart of a particular embodiment of a method 400 of transmitting a notification message based on blast data. In a particular embodiment, the method 400 may be performed by the blast module 102 in conjunction with the mobile communication device 106 of FIGS. 1 and 2 or by the mobile communication device 302 of FIG. 3. The method 400 includes receiving, via a wired interface of a mobile communication device, blast data based on one or more measurements from a blast sensor, at 402. For example, the wired interface may correspond to the interface adapter 112 of the mobile communication device 106 of FIG. 2. In another example, the wired interface may correspond to an internal wired interface coupling the blast sensor 310 to the processor 330 or to other components of the mobile communication device 302 of FIG. 3.

The method 400 may also include generating supplemental data at a sensor of the mobile communication device, at 404. For example, the supplemental data may include global positioning data, acceleration data, compass data, temperature data, audio data, video data, movement data, or a combination thereof. The method 400 may also include performing an analysis of the blast data and the supplemental data at the mobile communication device, at 406. For example, the processor 330 of the mobile communication device 302 of FIG. 3 may analyze blast data from the blast sensor 310 and additional data or supplemental data from the additional sensors 312. The notification message may be generated based on results of the analysis. As an example, the analysis may be used to estimate a severity of injuries to a user, a severity of a blast event, or other information relevant to response personnel to respond to a blast event.

The method 400 may also include initiating at the mobile communication device a test to assess a condition of the user of the mobile communication device, at 408. The test may be initiated after receiving the blast data. For example, the mobile communication device 302 of FIG. 3 may utilize the speaker 320, the microphone 322, the camera 326, the display 324, or a combination thereof, to interact with a user of the mobile communication device 302 to assess a condition of the user. Examples of tests that may be performed to assess the condition of the user include a speech response test, an eye dilation test, a breathing rate test, a heart rate test, or other tests. To illustrate, a graphical user interface (GUI) may be presented via the display 324 of FIG. 3. The GUI may present questions, visual puzzles, other cues, or a combination thereof to the user and may request that the user provide input responsive to the GUI via a touch screen interface of the display 324, via the microphone 322, or both. In another example, the speaker 320 may output prompts requesting that the user perform a particular action such as moving the mobile communication device 302, interacting with the touch screen interface of the display 324, providing speech input via the microphone 322, or a combination thereof. The processor 330 may process or analyze the input to determine a result of the test, and the result of the test may be indicated in the notification message 340. For example, the notification message 340 may indicate a score associated with the test or whether the user has passed or failed the test. Thus, the mobile communication device may facilitate remote assessment of the user after the blast to provide information to a responder.

The method 400 may also include transmitting, from the mobile communication device, a notification message based on the blast data, at 410. The notification message may also be based on other data. For example, the other data may include supplemental data or additional data provided by the additional sensors 312 of FIG. 3, results of the analysis of the blast data and the additional data, results of the test to evaluate the user, or a combination thereof. The method 400 may also include initiating a voice call, a data call, or a voice and data call from the mobile communication device to a remote device based on the blast data satisfying a threshold condition, at 412. To illustrate, when a severity of the blast is determined to satisfy a threshold condition based on the blast data, the mobile communication device 302 of FIG. 3 or the mobile communication device 106 of FIGS. 1 and 2 may open a voice communication channel, such as by initiating a call to the remote device 150 or to the remote device 350, respectively, in order to enable interaction between the user of the mobile communication device and response personnel associated with the remote device.

The method 400 of FIG. 4 may be initiated or controlled by a field-programmable gate array (FPGA) device, an application-specific integrated circuit (ASIC), a processing unit, such as a central processing unit (CPU), a digital signal processor (DSP), a controller, another hardware device, a firmware device, or any combination thereof. As an example, the method 400 of FIG. 4 may be initiated or controlled by one or more processors executing code (e.g., instructions stored in a memory device).

Figure 5:
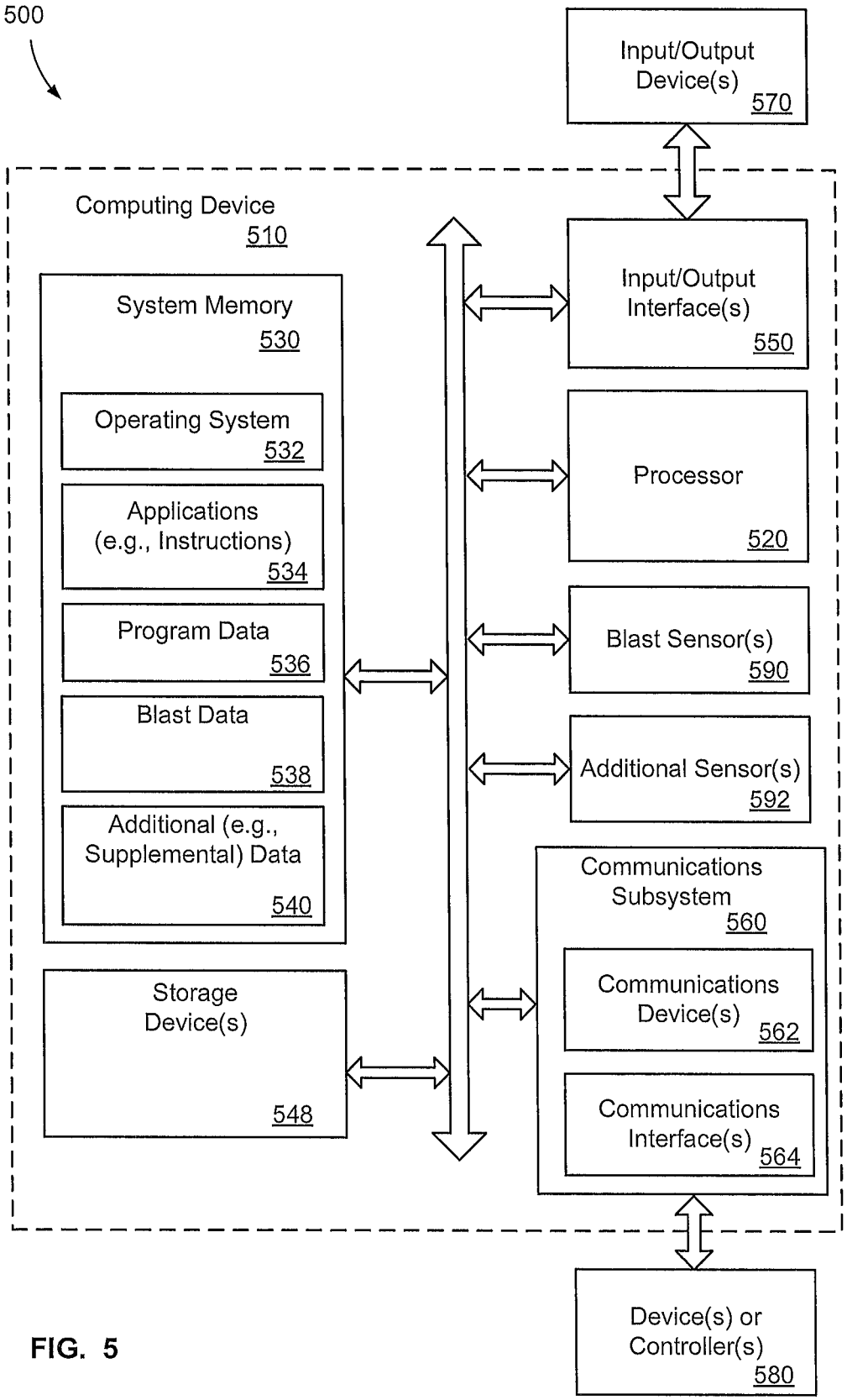
FIG. 5 is a block diagram that illustrates a particular embodiment of a computing system that transmits a notification message based on blast data.

FIG. 5 is a block diagram of a computer environment 500 including a computing device 510 configured to transmit a notification message based on blast data. For example, the computing device 510 may be included within or correspond to the mobile communication device 106 of FIGS. 1 and 2 or the mobile communication device 302 of FIG. 3.

The computing device 510 may include at least one processor 520. Within the computing device 510, the at least one processor 520 may communicate with a system memory 530, one or more storage devices 548, one or more input/output interfaces 550, a communication subsystem 560, one or more blast sensors 590, one or more additional sensors 592, or a combination thereof.

The system memory 530 may include volatile memory devices (e.g., random access memory (RAM) devices), nonvolatile memory devices (e.g., read-only memory (ROM) devices, programmable read-only memory, and flash memory), or both. The system memory 530 may include an operating system 532, which may include a basic input/output system for booting the computing device 510 as well as a full operating system to enable the computing device 510 to interact with users, other programs, and other devices. The system memory 530 may also include one or more applications (e.g., instructions) 534 and program data 536. The program data 536 may include data used by the applications 534 to perform respective functions of the applications 534. The applications 534 may include instructions executable by the at least one processor 520 to operate a mobile communication device, such as the mobile communication device 106 of FIGS. 1 and 2 or the mobile communication device 302 of FIG. 3, in accordance with the method 400 of FIG. 4, as further described herein.

The one or more storage devices 548 may include nonvolatile storage devices, such as magnetic disks, optical disks, or flash memory devices. The storage devices 548 may include both removable and non-removable memory devices. In a particular embodiment, the storage devices 548 may be configured to store the operating system 532, the applications 534, the program data 536, blast data 538, additional (e.g., supplemental) data 540, or a combination thereof. The system memory 530 and the storage devices 548 are physical devices and are not a signal.

In a particular embodiment, the at least one processor 520 is configured to execute computer executable instructions, such as the applications 534 (e.g., a blast response application), stored at the system memory 530. The instructions may be executable to cause the at least one processor 520 to perform operations. The operations may include receiving, via a wired interface, the blast data 538 based on one or more measurements from the one or more blast sensors 590. For example, the one or more blast sensors 590 may include one or more pressure sensors configured to provide pressure data to be stored as the blast data 538. The operations may further include transmitting, from the computing device 510, a notification message based on the blast data 538. For example, the computing device 510 may transmit the notification message based on the blast data 538 via the communications subsystem 560, as further described herein. In a particular embodiment, the notification message may be further based on the additional data 540 received from the one or more additional sensors 592. For example, the additional sensors 592 may include a temperature sensor, a GPS sensor, an acceleration sensor, or other sensors, and may provide temperature data, location data, acceleration data, or other data to be stored as the additional data 540. The operations may be similar to operations described with respect to the mobile communication device 106 of FIG. 2 or the mobile communication device 302 of FIG. 3, and/or operations in accordance with the method 400 of FIG. 4.

The one or more input/output interfaces 550 may enable the computing device 510 to communicate with one or more input/output devices 570 to facilitate user interaction. For example, the one or more input/output interfaces 550 may be adapted to receive input from a user via the one or more input/output devices 570. In a particular embodiment, the one or more input/output devices 570 may include a touch screen or a keypad. The input/output interfaces 550 may conform to one or more standard interface protocols, including serial interfaces (e.g., universal serial bus (USB) interfaces or Institute of Electrical and Electronics Engineers (IEEE) interface standards), parallel interfaces, display adapters, audio adapters, or custom interfaces. The input/output devices 570 may include user interface devices and displays, including some combination of buttons, keyboards, pointing devices, displays, speakers, microphones, touch screens, and other devices. The at least one processor 520 may detect interaction events based on user input received via the input/output interfaces 550. Additionally, the at least one processor 520 may send a display to a display device via the input/output interfaces 550.

The communication subsystem 560 may include one or more communication devices 562 and one or more communications interfaces 564 that may enable the computing device 510 to communicate with one or more other computing devices or controllers 580. In a particular embodiment, the one or more communication devices 562 may include a receiver and a transmitter. In another embodiment, the one or more communication devices 562 may include a transceiver. The one or more communications interfaces 564 may include wired Ethernet interfaces, Institute of Electrical and Electronics Engineers (IEEE) 802 wireless interfaces, Bluetooth communication interfaces, or other wired or wireless interfaces. The other computer devices or controllers 580 may include host computers, servers, workstations, portable computers, telephones, tablet computers, or any other communication device or component. For example, the other computer devices or controllers 580 may include or correspond to the remote device 150 of FIG. 2 or the remote device 350 of FIG. 3. The communication subsystem 560 may be configured to transmit the notification message to the other computer devices or controllers 580. For example, the communication subsystem 560 may enable the at least one processor 520 to transmit the notification message to the other computer devices or controllers 580 via the one or more communication devices 562, in a similar manner to transmitting the notification message 140 of FIG. 2 or the notification message 340 of FIG. 3.

Examples described above illustrate but do not limit the disclosure. It should also be understood that numerous modifications and variations are possible in accordance with the principles of the present disclosure. Accordingly, the scope of the disclosure is defined by the following claims and their equivalents.

The illustrations of the examples described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than shown in the figures or one or more method steps may be omitted. Accordingly, the disclosure and the figures are to be regarded as illustrative rather than restrictive.

Moreover, although specific examples have been illustrated and described herein, it should be appreciated that any subsequent arrangement designed to achieve the same or similar results may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. As the following claims reflect, the claimed subject matter may be directed to less than all of the features of any of the disclosed examples.

What is claimed is:

1. A device comprising:

an interface adapter configured to physically couple to a corresponding interface adapter of a phone and configured to communicate location data to the phone;

a blast sensor configured to generate blast data based on one or more measurements and to communicate the blast data to the phone via the interface adapter;

a light sensor configured to generate the location data, the location data based on ambient light detected at the light sensor prior to and after a blast event, the location data indicating displacement of the phone associated with the blast event, the displacement based on estimated locations of the phone prior to and after the blast event;

a controller configured to determine a severity level of the blast event based on the blast data and the location data, and to initiate transmission, via a communication system of the phone, of the blast data and the location data in response to the severity level satisfying a threshold; and a case configured to retain the phone, the blast sensor, and the light sensor by at least partially enclosing the blast sensor, the phone, and the light sensor.

2. The device of claim 1, wherein the one or more measurements include pressure measurements, wherein the blast sensor includes multiple pressure sensors that enable the blast sensor to determine a direction of propagation of a pressure wave, and wherein the blast data includes information indicative of the direction of propagation of the pressure wave.

3. The device of claim 1, further comprising an additional sensor to generate additional data, wherein the controller is configured to communicate the additional data to the phone via the interface adapter.

4. The device of claim 1, wherein the controller is configured to initiate an action in response to the blast data satisfying a threshold condition, wherein the action includes at least one of causing the phone to initiate a communication, causing audio data to be stored, causing the audio data to be transmitted, causing video data to be stored, or causing the video data to be transmitted.

5. The device of claim 1, further comprising a memory accessible to the controller, wherein the memory stores severity level data associated with multiple severity levels, and wherein the controller is configured to, in response to the blast data satisfying a threshold condition:

determine the severity level of the blast event based on the severity level data, the blast data, and the location data, wherein the severity level data is usable by the controller to correlate the blast data and the location data to the severity level of the blast event from the multiple severity levels;

compare the severity level to the threshold; and initiate transmission of a notification via the communication system in response to the severity level being greater than or equal to the threshold, the notification including the blast data, the location data, and an indication of the severity level.

6. The device of claim 1, wherein the controller is further configured to initiate transmission of a notification via the communication system of the phone, the notification including the blast data, the location data, and an indication of the severity level.

7. The device of claim 1, wherein the case is further configured to provide shock protection to the phone, and wherein the interface adapter is further configured to physically couple to the corresponding interface adapter of the phone while the phone is retained in the case.

8. The device of claim 1, wherein a first estimated location of the phone prior to the blast event is associated with a pocket of a user, wherein a second estimated location of the phone after the blast event is associated with a ground location proximate to the user, the location data indicating displacement of the phone from the pocket of the user to the ground location, and wherein the interface adapter is further configured to communicate the blast data to the phone while the interface adapter is physically coupled to the corresponding interface adapter of the phone.

9. A mobile communication device comprising:

a blast sensor configured to generate blast data based on one or more pressure measurements prior to and after a blast event;

a light sensor configured to generate location data, the location data based on ambient light detected at the light sensor prior to and after the blast event;

a communication subsystem configured to send and receive voice and data communications and to transmit a notification message associated with the blast event;

a processor configured to analyze the blast data and the location data to determine an estimated severity level of the blast event and to initiate transmission of the notification message in response to a determination that the estimated severity level satisfies a severity level threshold; and a memory accessible to the processor, wherein the memory stores instructions executable by the processor to initiate, based on detection of the blast event, a speech response test to assess a condition of a person after the blast event.

10. The mobile communication device of claim 9, further comprising:

a camera configured to capture image data, and a microphone configured to capture audio data, wherein the memory further stores instructions executable by the processor to generate post-blast data indicative of a location of the mobile communication device, movement of the person based on the audio data or the image data, or both, after the blast event, and wherein the notification message includes the post-blast data, the image data, the audio data, or a combination thereof.

11. The mobile communication device of claim 9, further comprising:

a touch screen interface; and a microphone, wherein the speech response test includes one or more prompts that request the person to move the mobile communication device, interact with the touch screen interface, provide a speech input via the microphone, or a combination thereof, and wherein the notification message indicates s result of the speech response test.

12. The mobile communication device of claim 9, further comprising one or more additional sensors configured to generate sensor data, wherein the notification includes the sensor data, and wherein at least a portion of the sensor data is associated with a time period before the blast event.

13. The mobile communication device of claim 9, wherein the memory further stores instructions executable by the processor to estimate an intensity of the blast event based on the blast data, and wherein the notification message indicates the intensity of the blast event.

14. The mobile communication device of claim 9, wherein the memory further stores instructions executable by the processor to estimate potential injuries of the person based on the blast data, and wherein the notification message indicates the potential injuries of the person.

15. A method comprising:

receiving, via a first wired interface of a mobile communication device, blast data based on measurements from a blast sensor;

receiving, via a second wired interface of the mobile communication device, location data from a light sensor, the location data based on ambient light detected at the light sensor prior to and after a blast event;

after receiving the blast data and the location data, initiating, at the mobile communication device, a test to assess a condition of a user of the mobile communication device, wherein the test includes at least a speech response test;

determining a severity level of the blast event based on the blast data and the location data;

in response to a determination that the severity level satisfies a severity level threshold, transmitting, from the mobile communication device, a notification message based on the blast data and the location data, wherein the notification message indicates a result of the speech response test; and after transmitting the notification message, initiating voice communication from the mobile communication device.

16. The method of claim 15, further comprising generating supplemental data at a sensor of the mobile communication device, wherein generation of the notification message is further based on the supplemental data, and wherein the supplemental data includes at least one of global positioning data, acceleration data, compass data, temperature data, audio data, video data, or movement data.

17. The method of claim 15, further comprising performing, at the mobile communication device, an analysis of the blast data and supplemental data generated at a sensor of the mobile communication device, wherein the notification message indicates results of the analysis.

* * * * *